US009433981B1

(12) United States Patent
Lofton

(10) Patent No.: US 9,433,981 B1
(45) Date of Patent: Sep. 6, 2016

(54) TANK CLEANING SYSTEM USING HEATED EXHAUST OR ENGINE WATER JACKET LIQUID

(71) Applicant: Dana W. Lofton, Houma, LA (US)

(72) Inventor: Dana W. Lofton, Houma, LA (US)

( * ) Notice: Subject to any disclaimer, the term of this patent is extended or adjusted under 35 U.S.C. 154(b) by 427 days.

(21) Appl. No.: 14/221,492

(22) Filed: Mar. 21, 2014

Related U.S. Application Data

(60) Provisional application No. 61/804,013, filed on Mar. 21, 2013.

(51) Int. Cl.

| | |
|---|---|
| ***B08B 9/093*** | (2006.01) |
| *B08B 3/08* | (2006.01) |
| *B08B 9/027* | (2006.01) |
| *B08B 9/08* | (2006.01) |
| *B08B 9/032* | (2006.01) |
| *B08B 3/04* | (2006.01) |
| *B08B 9/00* | (2006.01) |

(52) U.S. Cl.
CPC ..... *B08B 9/093* (2013.01); *B08B 3/04* (2013.01); *B08B 3/08* (2013.01); *B08B 9/00* (2013.01); *B08B 9/027* (2013.01); *B08B 9/032* (2013.01); *B08B 9/08* (2013.01); *B08B 9/0813* (2013.01); *B08B 9/0933* (2013.01)

(58) Field of Classification Search
CPC ..... B08B 9/093; B08B 9/00; B08B 9/027; B08B 9/032; B08B 9/08; B08B 9/0813; B08B 9/0933; B08B 3/04; B08B 3/08
See application file for complete search history.

(56) References Cited

U.S. PATENT DOCUMENTS

| | | | | |
|---|---|---|---|---|
| 2,074,052 | A * | 3/1937 | George | B05B 3/066 239/227 |
| 3,450,086 | A * | 6/1969 | Maddock | B01D 17/0208 114/74 R |
| 3,860,018 | A * | 1/1975 | Reiter | B01F 13/00 134/166 R |
| 5,282,889 | A * | 2/1994 | Franklin | B08B 9/093 134/169 R |
| 5,469,598 | A | 11/1995 | Sales | |
| 5,769,958 | A * | 6/1998 | Reagan | B08B 9/093 134/22.1 |
| 6,675,437 | B1 | 1/2004 | York | |
| 2007/0095370 | A1 | 5/2007 | Kratser | |

* cited by examiner

*Primary Examiner* — Bibi Carrillo
(74) *Attorney, Agent, or Firm* — Warner J. Delaune; Baker Donelson, et al.

(57) ABSTRACT

A cleaning system and method for tanks on a vessel is provided, wherein the vessel includes an engine using a keel cooler (closed loop) or ambient water (open loop) as a coolant, and wherein heated coolant is discharged from the engine through an engine water jacket or engine exhaust. The system comprises a diverter valve operatively disposed between the engine and the engine exhaust or engine water jacket, the diverter valve capable of redirecting the heated coolant from being discharged through the engine water jacket or engine exhaust. An auxiliary pump is fluidically connected between the sea cock and the diverter valve to replace the heated coolant redirected by the diverter valve with ambient water injected back into the exhaust or keel coolers. A reservoir is fluidically connected to the diverter valve and adapted to receive the heated coolant. A cleaning pump is fluidically connected to the reservoir and adapted to transfer heated coolant from the reservoir, and one or more nozzles are fluidically connected to the cleaning pump and adapted to spray the heated coolant onto interior surfaces of a tank. A scavenging pump is fluidically connected to the tank, and a waste tank is fluidically connected to the scavenging pump to store the waste.

8 Claims, 2 Drawing Sheets

TANK CLEANING SYSTEM USING HEATED EXHAUST OR ENGINE WATER JACKET LIQUID

CROSS-REFERENCE TO RELATED APPLICATIONS

This application claims the benefit under 35 U.S.C. §119 (e) to provisional application Ser. No. 61/804,013, filed Mar. 21, 2013.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The invention relates generally to devices and methods used in the cleaning of tanks and reservoirs on offshore supply vessels in the oilfield industry, and more particularly to those devices and methods which employ a heated fluid.

2. Description of Related Art

The cleaning of mud tanks or reservoirs is an important requirement of the oil and gas industry. Offshore supply vessels (OSV's) are in constant need of having their tanks cleaned and prepared for different cargos that are transported to platforms in the Gulf of Mexico and around the world. Typical cargos include oil, distillate, water, oil-based mud, and water-based mud.

During a typical operation, the OSV will be loaded with drilling fluids, such as oil-based or water-based mud at a dock, and the OSV delivers the cargo to an offshore oil production platform for use in its daily operations. Upon delivery of the cargo, the OSV must then return to the port to re-load cargo and deliver cargo again. This cycle may continue for days or weeks at a time with a quick turnaround at the port as long as the cargo remains the same.

However, if the cargo changes characteristics, e.g. oil-based to water-based mud, the tanks must be cleaned and prepared for the different cargo. This cleaning process starts after vessel is in port. The conventional cleaning method is labor intensive and hazardous, because it involves workers performing these tasks in confined spaces with prolonged exposure time to fumes and chemicals.

Most OSV's have wash down nozzles and scavenging pumps mounted in the tanks designed to rinse the walls with potable water and evacuate the waste (potable water included) out of the tank, and then transfer the bulk waste off the vessel. Once the tank has been rinsed by the vessel equipment, a 4-6 man crew must be hired with pressure washers, SCBA's (Self Contained Breathing Apparatus for the confined space exposure), and all required PPE (Personal Protective Equipment) to allow restricted access into the tanks for final cleaning. The disadvantage of the conventional cleaning process is that the OSV is tied up in port for 4-6 hours per tank. On a vessel with 8 tanks, this equates to approximately 40 hours of down or dock time when the vessel cannot be used in normal operation, along with the added expense of the hired crew and hazard insurance. This lowers the vessel's utilization rate and raises the customer's cost dramatically.

SUMMARY OF THE INVENTION

One object of the invention is to provide a method and apparatus that can clean OSV tanks in a faster, safer, and more efficient manner as opposed to the conventional method described above. The method employs a heated wash fluid into the tanks by way of engine coolant taken from the sea water surrounding the vessel in an open loop system or by isolating and replacing the keel cooler system (closed loop system) with sea water. This method reduces confined space exposure in hazardous surroundings by approximately 78% (seventy-eight percent), and raises vessel utilization by approximately 40% (forty percent), thereby lowering customer's cost and platform down time.

Another object of the invention is to provide a cleaning system for tanks on a vessel, wherein the vessel includes an engine using ambient water as a coolant, and wherein heated coolant is discharged from the engine through an engine exhaust or water jacket surrounding the engine, comprising a first diverter valve operatively disposed between the engine and the engine exhaust or water jacket, the first diverter valve capable of redirecting the heated coolant from being discharged through the engine exhaust or into the keel cooler; a reservoir fluidically connected to the first diverter valve and adapted to receive the heated coolant; a cleaning pump fluidically connected to the reservoir and adapted to transfer heated coolant from the reservoir; one or more nozzles fluidically connected to the cleaning pump and adapted to spray the heated coolant onto interior surfaces of a first tank; a scavenging pump fluidically connected to the first tank; and a waste tank fluidically connected to the scavenging pump.

Optionally, the invention may further comprise an auxiliary pump operatively disposed between the ambient water and the first diverter valve.

Another object of the invention is to provide a second tank and a second diverter valve operatively disposed between the cleaning pump and the first tank, wherein the heated coolant can be redirected to the second tank.

Preferably, the reservoir is insulated sufficient to preserve the heated coolant at a predetermined temperature, and the further includes a fluid level sensor.

In a preferred embodiment, the fluid level sensor is electronically connected to a control panel, and wherein the level detected by the fluid level sensor affects the operation of the cleaning pump, an auxiliary pump, and the first diverter valve.

In a more preferred embodiment, the fluid level sensor causes operation of the cleaning pump when the level in the reservoir reaches a predetermined level.

In a further embodiment, the fluid level sensor causes operation of the first diverter valve to redirect the heated coolant to the reservoir when the level in the reservoir reaches a predetermined level.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
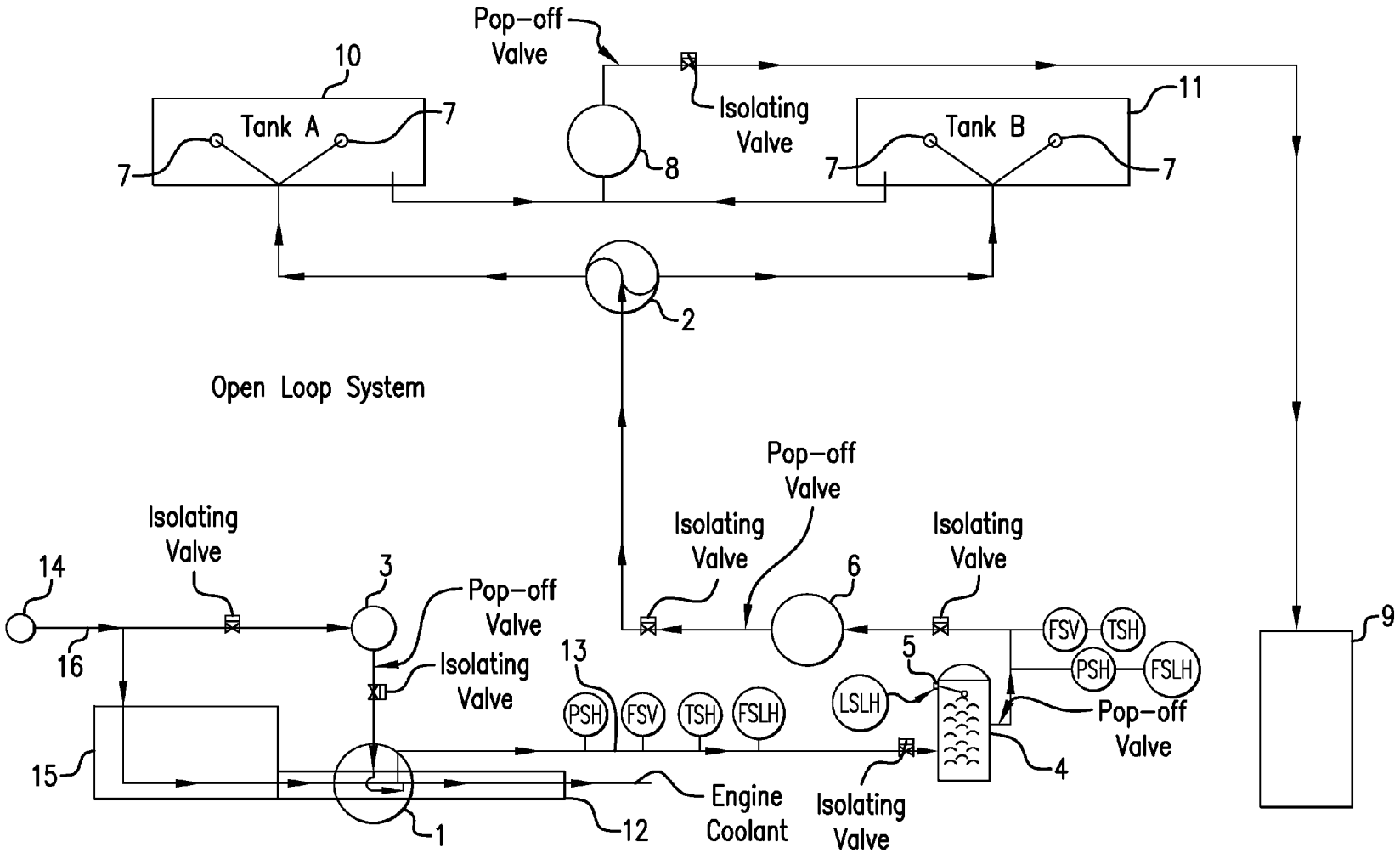
FIG. 1 illustrates a component and flow diagram in accordance with a preferred embodiment of the invention in an open loop environment.
Figure 2:
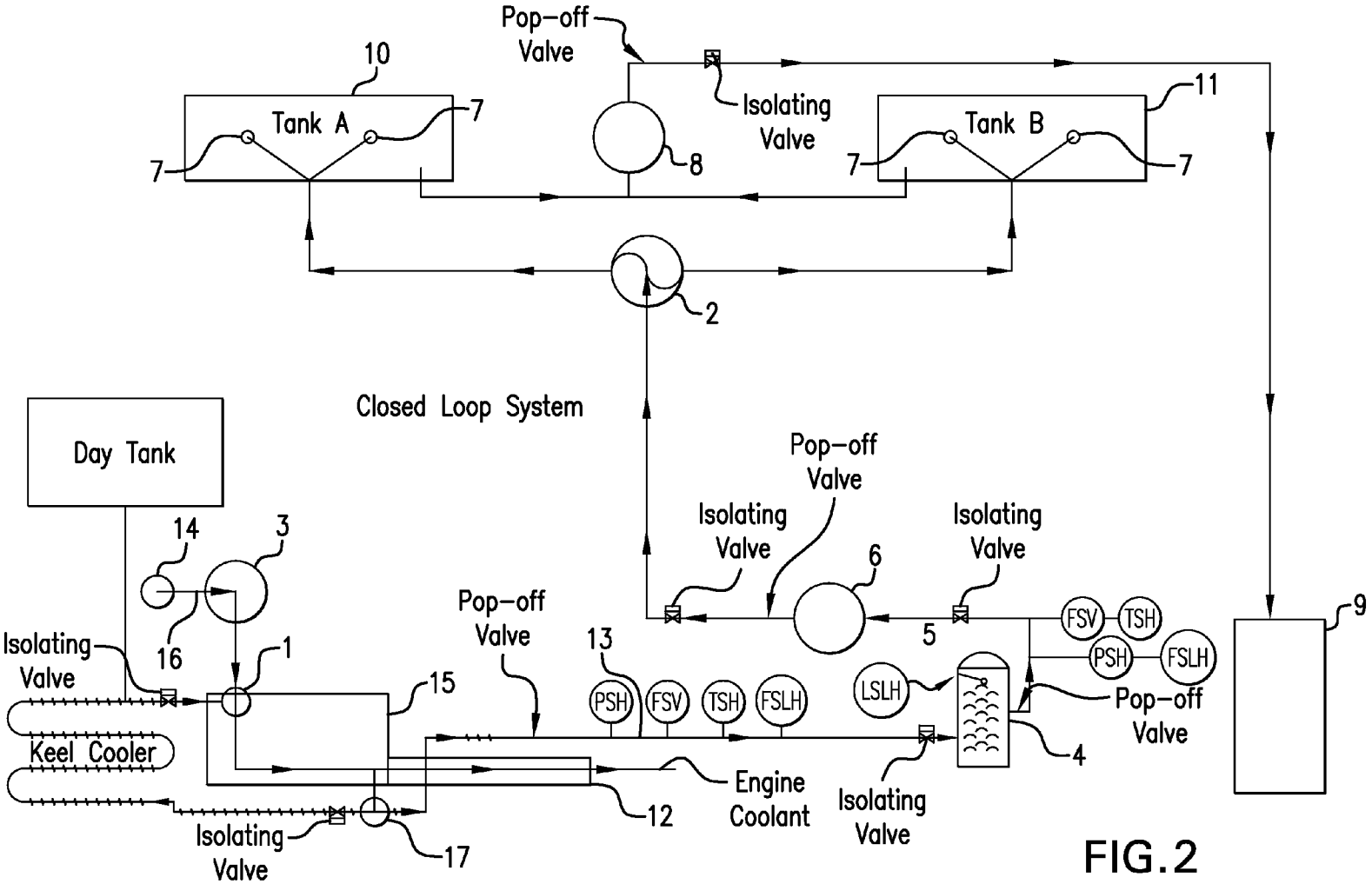
FIG. 2 illustrates a component and flow diagram in accordance with a preferred embodiment of the invention in a closed loop environment.

Referring now to FIG. 1 (an open loop system) and FIG. 2 (a closed loop system), schematic diagrams shows the components and flow of two preferred embodiments of the present invention. Only two tanks are shown for simplicity, although it should be understood that more tanks (typically eight) are present on most OSV's. A prime mover, or engine 15, on the OSV provides propulsion for the vessel, and the engine 15 includes a sea cock 14 which controls intake of ambient sea water 16. The sea water 16 is used as an engine coolant by transferring heat away from the engine 15. On vessels without the present invention, the heated sea water coolant is simply discharged back to the sea or the keel cooler via engine exhaust 12 or the engine's water jacket. However, when the present invention is installed on the OSV, the heated coolant is re-routed and used in the manner described below before being discharged. It is also possible for the engine coolant to be a common anti-freeze coolant, such as ethylene glycol or similar fluids.

A first diverter valve 1 is operatively disposed between the engine 15 and the engine exhaust 12, which redirects heated engine coolant 13 to a stainless steel insulated reservoir 4. The reservoir 4 may be any suitable size, but a 250-gallon reservoir may be sufficient for most applications. Concurrently with the redirection of engine coolant 13 to the reservoir 4, an auxiliary pump 3 fluidically connected between the sea cock 14 and the engine exhaust 12 or engine water jacket is activated, which causes sea water 16 to replace fluid in the exhaust system 12. This action avoids overheating of the exhaust pipes and minimizes ambient hull temperature of the vessel.

The insulated reservoir 4 includes a fluid level sensor 5 which is electronically connected to a central control panel, and which determines the operation of other components within the system. When the insulated reservoir 4 fills to approximately 150 gallons (or some other predetermined level suitable to the circumstances), the fluid level sensor 5 energizes the cleaning pump 6 and the scavenging pump 8, allowing mud tank cleaning to begin in a first tank, such as Tank A 10. The cleaning pump 6 forces the heated engine coolant 13 through a second diverter valve 2 which allows redirection of fluid between a plurality of tanks. Actual tank cleaning is accomplished by nozzles 7 located in each of the tanks 10, 11, or through portable nozzle equipment, consistent with equipment and hardware known to those in the industry. The nozzles 7 discharge the heated engine coolant 13 onto the tank interior surfaces, and this heated wash-down of the tank is substantially more effective than conventional methods using ambient temperature water.

In an open loop system as shown in FIG. 1, if the level in the insulated reservoir 4 exceeds approximately 225 gallons as indicated by the fluid level sensor 5, the system will begin "normal operation mode", causing the first diverter valve 1 to switch to a position which permits all engine coolant 13 to be discharged through the engine exhaust 12, and causing the auxiliary pump 3 to shut off.

In a closed loop system as shown in FIG. 2, if the level in the insulated reservoir 4 exceeds approximately 225 gallons as indicated by the fluid level sensor 5, the system will begin "stand-by operation mode", causing diverter valve 17 to switch to a position which permits all engine coolant 13 to be discharged through the engine exhaust 12.

In the open loop system of FIG. 1, when the level in the insulated reservoir 4 falls to a level between approximately 150 and 225 gallons as indicated by the fluid level sensor 5, the first diverter valve 1 will reactivate, along with the auxiliary pump 3, to redirect more engine coolant 13 to the reservoir 4, which starts the cleaning operation again.

In the closed loop system of FIG. 2, if the level in the insulated reservoir 4 falls to a level between approximately 150 and 225 gallons as indicated by the fluid level sensor 5, diverter valve 17 will reactivate, redirecting more engine coolant 13 to the reservoir 4, which starts the cleaning operation again.

In both the open loop system of FIG. 1 and the closed loop system of FIG. 2, when the level in the insulated reservoir 4 falls to a level below about 100 gallons as indicated by the fluid level sensor 5, the cleaning pump 6 is shut off, and the second diverter valve 2 will move to a neutral position.

During the cleaning activity, the waste fluid is pumped out of Tank A 10 by the scavenging pump 8 which is built into the vessel and fluidically connected to a drain in the tank 10. Importantly, the scavenging pump 8 should be sized with the corresponding capacity of the cleaning pump 6, so that a proper wash-down and evacuation of waste fluids can be achieved. The scavenging pump 8 will continue operating until the waste fluid level in the tank reaches a predetermined level, after which it will shut off.

The waste fluid is directed to another waste tank 9 for storage until the vessel reaches the port where it can be disposed of according to local codes.

Once the first tank, Tank A 10, is cleaned, the second diverter valve 2 is actuated, and the heated fluid can be re-directed to another mud tank, such as Tank B 11, for cleaning. As indicated previously, a plurality of tanks can be cleaned in serial fashion until all available tanks are cleaned.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method for cleaning a tank comprising the steps of:

(a) providing an engine in communication with a coolant comprising ambient water or engine cooling fluid;

(b) heating the coolant, wherein heated coolant is discharged from the engine through an engine exhaust;

(c) providing a diverter valve operatively disposed between the engine and the engine exhaust, and causing the diverter valve to redirect the heated coolant from being discharged through the engine exhaust or into a keel cooler;

(d) providing a reservoir fluidically connected to the diverter valve and redirecting the heated coolant from the engine to the reservoir;

(e) providing a cleaning pump fluidically connected to the reservoir and transferring the heated coolant from the reservoir to the tank;

(f) providing one or more nozzles fluidically connected to the cleaning pump;

(g) cleaning the tank by spraying the heated coolant from one or more of said nozzles onto interior surfaces of the tank; and (h) providing a scavenging pump fluidically connected to the tank, and transferring the sprayed coolant to a waste tank fluidically connected to the scavenging pump.

2. The method of claim 1, further including an auxiliary pump operatively disposed between the ambient water or engine cooling fluid and the diverter valve.

3. The method of claim 1, further including:

(a) a second tank; and (b) a second diverter valve operatively disposed between the cleaning pump and the tank, wherein the heated coolant can be redirected to the second tank.

4. The method of claim 1, wherein the reservoir is insulated to preserve the heated coolant at a predetermined temperature.

5. The method of claim 1, wherein the reservoir includes a fluid level sensor.

6. The method of claim 5, wherein the fluid level sensor activates the cleaning pump when the level in the reservoir reaches a predetermined level.

7. The method of claim 5, wherein the fluid level sensor activates the diverter valve to redirect the heated coolant to the reservoir when the level in the reservoir reaches a predetermined level.

8. The method of claim 5, wherein the fluid level sensor activates the auxiliary pump to redirect additional heated coolant to the reservoir.

* * * * *